United States Patent [19]

Goldbeck et al.

[11] Patent Number: 4,909,167

[45] Date of Patent: Mar. 20, 1990

[54] METHOD AND DEVICE FOR ATTACHING A POCKET INSERT

[75] Inventors: Heinz Goldbeck; Klaus Moller, both of Bielefeld; Helmut Gogolin, Goslar, all of Fed. Rep. of Germany

[73] Assignee: Durkoppwerke GmbH, Fed. Rep. of Germany

[21] Appl. No.: 267,976

[22] Filed: Nov. 7, 1988

[30] Foreign Application Priority Data

Nov. 7, 1987 [DE] Fed. Rep. of Germany ..... 3737923

[51] Int. Cl.[4] ..... D05B 3/04; A41D 27/20

[52] U.S. Cl. ..... 112/265.1; 112/104

[58] Field of Search ..... 112/104, 121.11, 121.12, 112/265.1

[56] References Cited

U.S. PATENT DOCUMENTS

| | | | |
|---|---|---|---|
| 3,747,544 | 7/1973 | Nicolay et al. . | |
| 4,589,358 | 5/1986 | Goldbeck et al. . | |
| 4,665,843 | 5/1987 | Goldbeck et al. . | |
| 4,711,188 | 12/1987 | Yoneda | 112/104 |

FOREIGN PATENT DOCUMENTS

| | | | |
|---|---|---|---|
| 1460153 | 11/1968 | Fed. Rep. of Germany | 112/121.11 |
| 3018886 | 12/1980 | Fed. Rep. of Germany . | |
| 3346163 | 4/1985 | Fed. Rep. of Germany . | |

OTHER PUBLICATIONS

DNZ International, 9/87, Pfaff Paspelautomaten Mikroprozessorsteuerung, at p. 44.

*Primary Examiner*—Werner H. Schroeder
*Assistant Examiner*—David K. Suto
*Attorney, Agent, or Firm*—Ostrolenk, Faber, Gerb & Soffen

[57] ABSTRACT

A small part (42) is automatically lowered, with its front side (76) facing upward, directly onto a main part (43) which is spread out on a worktable (2), the front side (76) of said main part also facing upward. The respective patterns of the main part (43) and the small part (42) are aligned. Then the small part (42) is automatically turned over, whereby it then can be deposited, with its front side (76) facing downward, on a sewing-material clamp (8). The latter transports both the main and small sewing parts, fixed in position, first to the sewing station (68) and then to the cutting station (6).

18 Claims, 6 Drawing Sheets

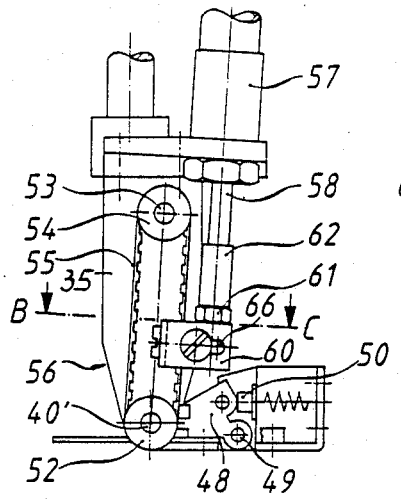
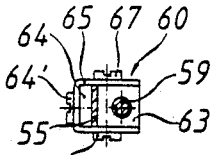
Fig. 4a
Fig. 4
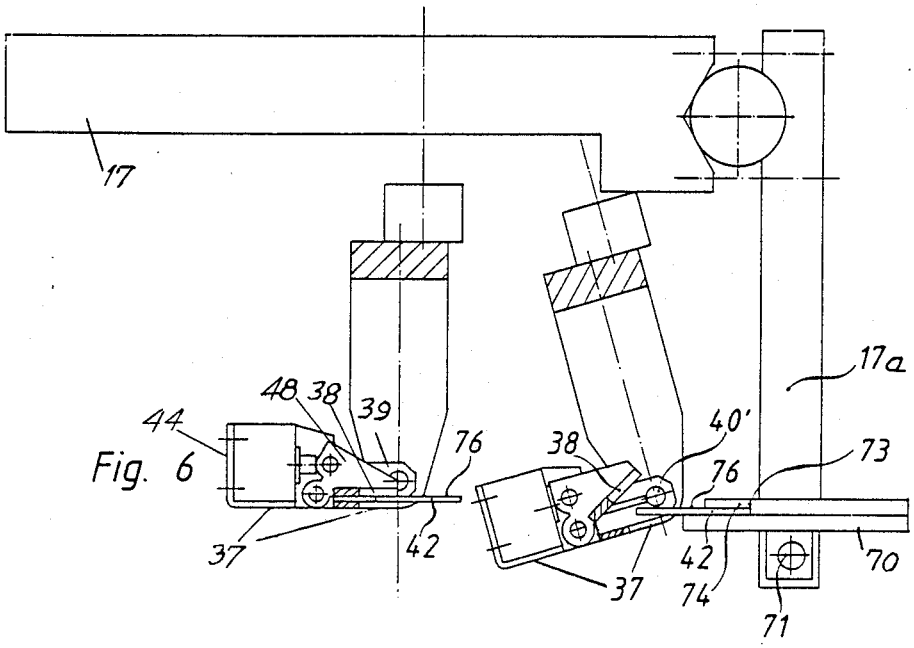
Fig. 6
Fig. 5
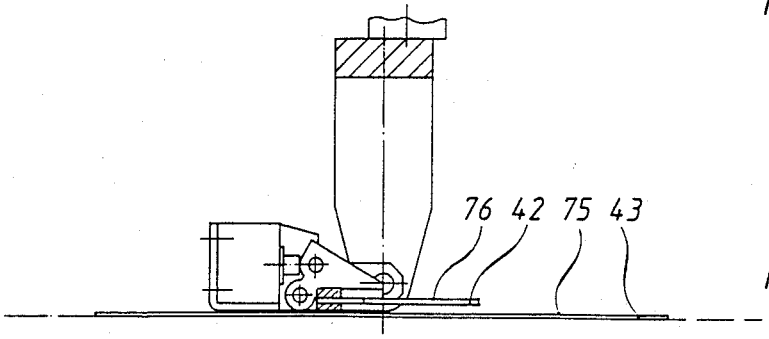
Fig. 7

METHOD AND DEVICE FOR ATTACHING A POCKET INSERT

BACKGROUND OF THE INVENTION

1. Field of the Invention

The present invention relates to a method of attaching a small sewing part to a main sewing part to form a pocket insert, and to a device by which said method is carried out.

2. Description of Related Art

One prior method in this field was described in the journal "DNZ", No. 9/1987, on page 44, which includes a picture captioned "Production of a Breast Selvage Pocket". In this known method for the production of a breast selvage pocket, a main sewing part, with its front side facing upward, is spread out on the worktable of the automatic sewing machine and aligned in accordance with the proper seating of the pocket insert which is to be made. Then the main sewing part is held fast in fixed position on the worktable by a lowered clamp for the material being sewn. Finally, a prefabricated small sewing part is placed by hand, with its visible side downward, at a predetermined place on the sewing-material clamp. After the small part has been clamped fast on the sewing-material clamp, the latter transports the main part and the small part to the sewing station and then to the cutting station.

For aligning the small part and the main part for proper pattern-matching, it was heretofore customary in the industry for the exact position of the small part to be designated by corresponding markings on the main part, for guiding the subsequent sewing of the small part onto the main part. These markings corresponded to the corner points of the small part, and fixed the course of the seam to be sewn. In order to optimally utilize the capacity of an automatic pocket insert sewing machine, these markings were made by another employee at an additional workplace located as close nearby as possible. But in he case of prefabricated sewing parts of patterned material, mismatches in pattern between the small part and the main part sometimes were discovered after the small part was sewn on, and as a result, disagreeable disputes, prejudicial to the working climate, frequently arose as to which workplace—the workplace for the marking step or the workplace for the locating and aligning steps—had made the mistake.

As a matter of fact, incorrect marks, incorrect alignment of the marked main part (which may be placed on the worktable under the guidance of marking lights), and incorrect application of the small part, are all possible causes for the small part being sewn on without proper matching of the pattern.

In order to avoid these problems, another method of operation, described briefly below, has at times been used. In accordance with this method, the small sewing part is aligned with its pattern matched to the main part directly on the automatic sewing machine, and then, both the main part and the aligned small part resting on it are shifted in such a manner—without interfering with the alignment—hat the end points of the small part coincide with light markings produced by marking lights. (In this case, the aforementioned marking step can be dispensed with)

Both the one method (with marks) and the other method (without marks) have the following problem: The front side of the small sewing part must face upward in order to match its pattern to the main sewing part. But then the small part, starting from this position, must be turned through an angle of about 180° before being placed at the predetermined spot on the sewing-material clamp, since the first step in attaching the small part to the main part is to sew its still-open longest side to the main part with the visible side of the small part facing downward Thus, the two operations which have just been described have the common disadvantage that the operator, after the above-described pattern-matching alignment, must manually remove the small part from the main part, which, in the meantime, has been fixed in position, and then place it with its front side facing downward on the sewing material clamp, which is present in the meantime at the feed station, as shown in the above-cited prior art publication.

In addition, the position-limiting stops on the sewing material clamp must be adjusted very carefully, to achieve the desired sewing and pattern-matching results. Both methods of operation have the disadvantage that when the small part is removed and placed on the sewing material clamp, the small part can pull or stretch, particularly if it is made of loosely woven goods. This pulling or stretching makes it impossible for the pattern of the small part to match the main part after it is sewn on, even though the small part has previously been aligned on the main part with its pattern precisely matched.

SUMMARY OF THE INVENTION

The object of the invention is thus to provide a method, and a device which carries out the method, which makes it possible to automatically, and mechanically, attach a pocket insert by placing the small part on the main part, with pattern-matching alignment of the small part in accordance with the pattern of the main part on which it is placed, and then turning the small part to orient it properly for sewing.

This object is achieved in a method of attaching a pocket insert, comprising the steps of:

- spreading out a main sewing-material part with an upward-facing front side and aligned at a redetermined position on a worktable of an automatic pocket-insert sewing machine;
- lowering a sewing-material clamp onto the main part;
- placing a small sewing part with a downward-facing fronts side at a predetermined position on the sewing-material clamp; and
- swinging a clamp lever on the sewing-material lamp to fix the position of the small part relative to the main part.

Then, the main part and the small part are transported by the sewing-material clamp to a sewing station and then to a cutting station of the automatic pocket-insert sewing machine.

The object is further achieved in an automatic pocket-insert sewing machine comprising:

- a frame; a feed station, sewing station and cutting station defined with respect to the frame; and a worktable supported on the frame;
- a two-needle sewing machine on the frame;
- cutting means disposed for cutting workpieces at a portion thereof between the respective sewing paths of the two sewing needles;
- a carrier swingably supported with respect to the sewing machine and having supporting beam means mounted for linear displacement therein;

a sewing-material clamp for the transport of a main sewing part and a small sewing part which is movable between the feed station and the cutting station; holding-down means provided in the vicinity of the sewing station for holding down workpieces; and cutting means at the cutting station for producing gusset cuts at the ends of the small sewing part; and feed table means which is arranged for receiving said small part with a predetermined orientation with respect to the frame and the sewing machine.

By such method and device, it is now possible to produce an accurate pocket insert, in an efficient manner, even with prefabricated small sewing parts which are made from patterned (e.g., striped or checkered) goods. In addition to the advantageous, streamlined aspect of the manner of operation, which is substantially independent of the operator, mention should also be made of the considerable economy of the method. With this method it is possible to eliminate one work station. And furthermore, it is possible to feed the next small part, which will be sewed on in the following sewing operation, during the sewing operation which has just been carried out, so an efficient overlapping manner of operation is feasible.

Importantly, the method of this invention comprises carrying out the following steps at a feed station for sewing on the small part in accordance with the pattern of the main part:

clamping the small part on one side in a transfer unit and moving the transfer unit to a low position in which the upward-facing front side of the small part is directly above the spread-out main part;

aligning the main part in accordance with the direction of the pattern of the small part, and then holding the main part fast in fixed position on the worktable;

moving the transfer unit to a raised position, which removes it from the path of the sewing-material clamp into the feed station and, at the same time, turning the small part in the transfer unit so that its front side now faces downward; and placing the small part on the sewing material clamp, clamping the small part fast thereon, and then loosening its unilateral clamping in the transfer unit and releasing it from the transfer unit.

The device of the invention advantageously comprises transfer means supported on said support beam means for transferring said small part from said feed table to said sewing-material clamp.

BRIEF DESCRIPTION OF THE DRAWINGS

Embodiments of the invention will now be explained, with reference to FIGS. 1 to 10, in which:

FIG. 4 is a side view of the transfer unit 31, as seen in the direction of the arrow A in FIG. 3;

FIG. 4*a* is a top view of the clamping pedestal 60, as seen along the section line B–C in FIG. 4;

FIG. 5 is a simplified cross-sectional view taken according to the section line D–E in FIG. 3, showing the transfer unit in its transferring position, wherein the front side 76 of the clamped small sewing part 42 faces upward;

FIG. 6 is a view similar to FIG. 5, of the transfer unit in its raised position, the front side of the clamped small part still facing upward;

FIG. 7 is a view similar to FIG. 5, of the transfer unit, shown in its lowered position, the front side of the clamped small part still facing upward;

DETAILED DESCRIPTION OF THE EMBODIMENTS

Figure 1:
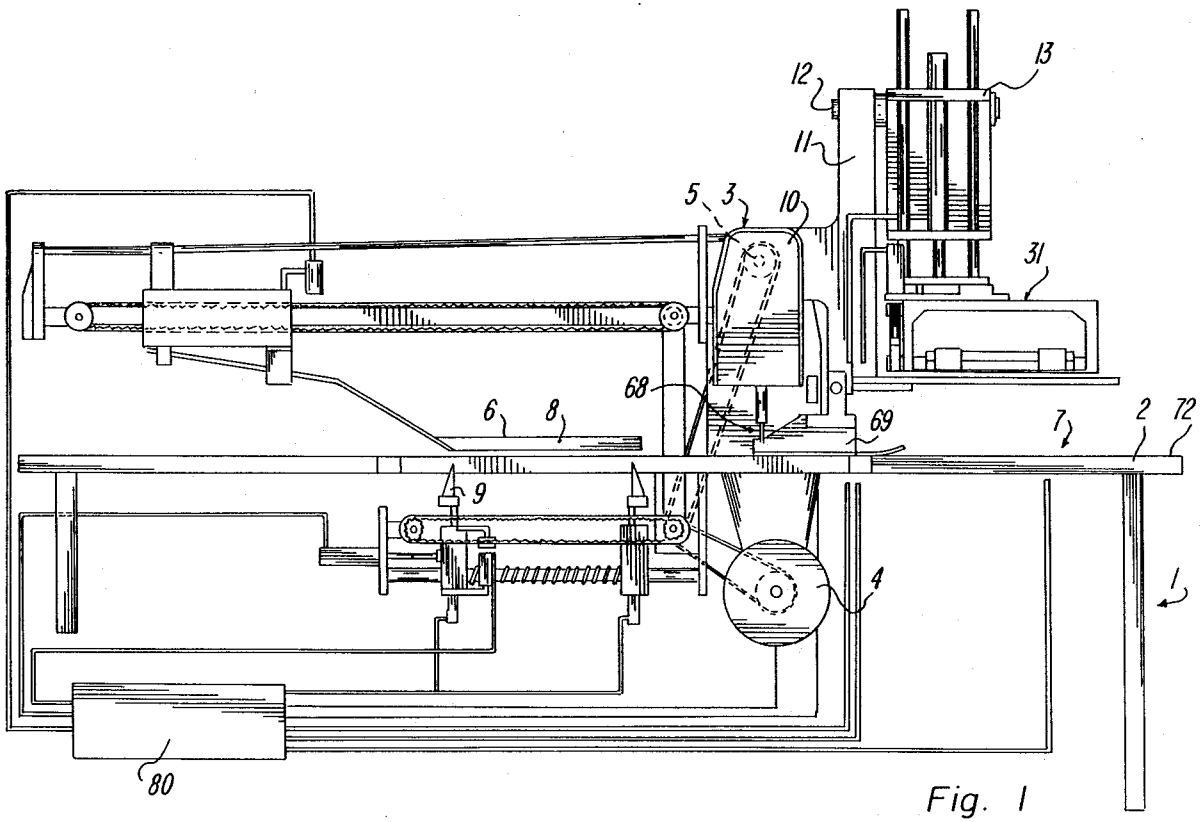
FIG. 1 is a simplified front view of an automatic pocket-insert sewing machine according to the embodiment, certain components being omitted for clarity.
Figure 2:
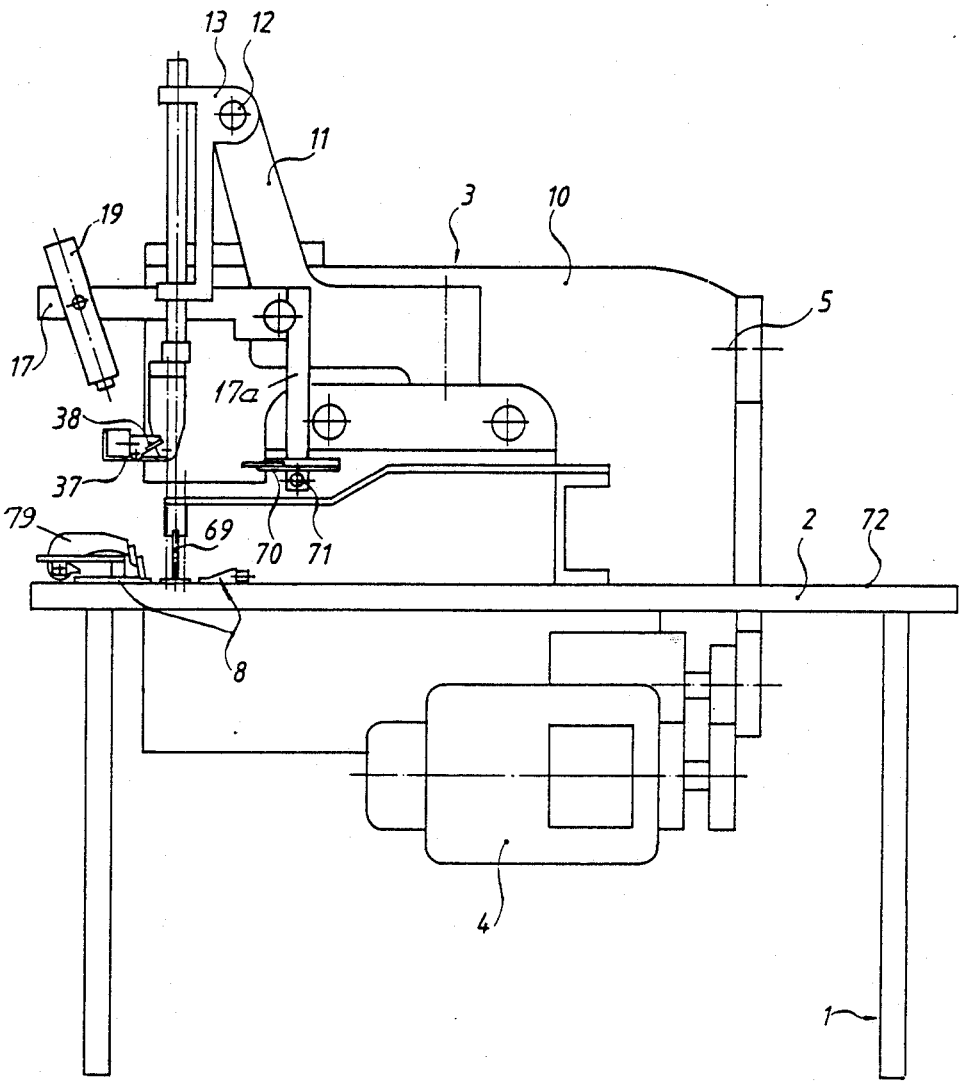
FIG. 2 is a simplified side view of a portion of the automatic pocket-insert sewing machine.

The automatic pocket-insert sewing machine shown in FIGS. 1 and 2 is constructed on a frame 1 having a worktable 2, which receives a two-needle sewing machine 3 of known construction. A common drive 4 which is fastened to the bottom of the worktable 2 drives an arm shaft 5 of the sewing machine 3, a sewing-material clamp 8 which can be moved between a cutting station 6 and a feed station 7, and a variable-position gusset knife 9. The functional relationship between the drive 4 and the above-mentioned structural parts or assemblies that it drives is known from Federal Republic of Germany Pat. No. 34 04 758 or from Federal Republic of Germany OS No. 35 12 772 and therefore need not be described in detail here. The disclosures of all the prior art documents mentioned in this disclosure are expressly incorporated by reference herein.

Figure 3:
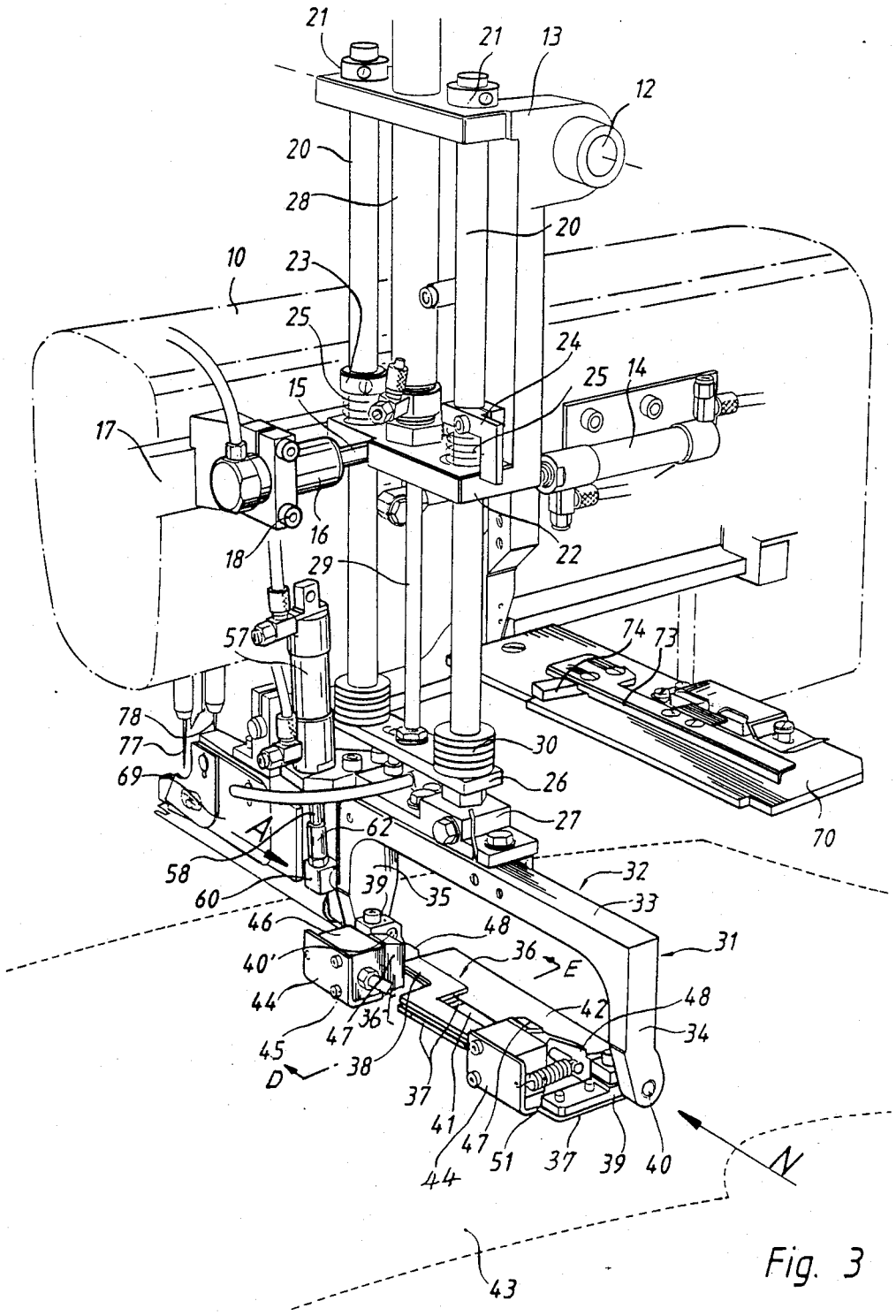
FIG. 3 is a simplified perspective view of a portion of the automatic pocket-insert sewing machine, certain parts of which are shown in heavy lines.

Referring now to FIGS. 1–3, a bearing pedestal 11 which bears a journal 12 is firmly connected to an arm 10. On said journal there is mounted a carrier 13 which, by means of the corresponding action of a double-acting compressed-air cylinder 14 fastened to the arm 10, can be swung so far in clockwise direction (as seen in FIG. 2) as permitted by an extended ram 15, acting as a stop, which is actuated by a single-acting second compressed-air cylinder 16 which controls the ram 15 to stop the carrier 13 in the desired position. The compressed-air cylinder 16 is connected via a spar 17, fixed with respect to the frame, to the arm 10. After loosening two screws 18, its position relative to the carrier 13 can be changed. The spar 17 furthermore receives two ordinary commercial variable-position marking lights 19 which can be noted in FIG. 2.

Two guide bars 20 are displaceably mounted in the carrier 13. On their upper ends there are fastened two setting rings 21, which limit the low position, shown in FIG. 3, of the guide bars 20. A second arm 22 is provided on the carrier 13. Compression springs 25 are provided between the top of this second arm 22 and the bottom of another setting ring 23 fastened on one of the guide bars 20, and the bottom of a clamping part 24 fastened on the other guide bar, for damping the impact when the guide bars 20 pass into their lowered position. The lower ends of the two guide bars 20 extend into a yoke 26 to which they are firmly connected. A supporting beam 27 is also firmly connected to the yoke 26.

Another double-acting compressed-air cylinder 28, whose piston rod 29 has a threaded extension, is mounted on the arm 22. The latter is screwed into the yoke 26, so the displacement movement of the retractable and extendable piston rod 29 is transmitted directly to the yoke 26 and the support beam 27. The low position of the support beam 27 is defined by the setting rings 21. In the retracted position of the piston rod 29, rubber discs 30 on both guide bars 20 damp the upper position of the yoke 26.

On the supporting beam 27 there is fastened a transfer unit 31 which comprises a U-shaped frame 32. The frame is formed of a web 33, a first spar 34, and a second spar 35. A clamping clip 36 is rotatably mounted on the spars 34, 35. The clamping clip 36 comprises a support angle 37 and a clamping ledge 38. At both transverse sides of the support angle 37 are fastened bearing pedestals 39, each of which receives a pin, 40 and 40' respectively. The rotatability of the clamping clip 36 which is achieved thereby is characterized by the fact that the axes of symmetry of the pins 40, 40' point substantially toward the center of a left-hand sewing needle 77. The long side of the clamping ledge 38 as well as that of the support angle 37 is provided, according to FIG. 3, in its central region with a U-shaped recess 41. As a result of this recess 41, the course of the pattern of a small part 42, even in the unclamped region, can be controlled with respect to the course of the pattern of a main sewing-material part 43.

Figure 6A:
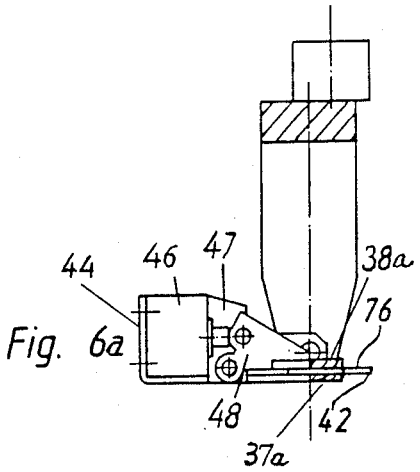
FIG. 6*a* shows the small part clamped in the clamping clip of a transfer unit according to a modified embodiment, the longitudinal sides of the small part extending beyond the clamping clip.

In another embodiment, shown in FIG. 6*a*, the clamping clip 36*a* grips the small part 42 in such a manner that the long sides thereof extend beyond the clamping clip 36*a* on both sides, as a result of which the course of the pattern, in particular on the two long sides of the small part 42, can be compared with the course of the pattern of the main part 43.

Figure 6B:
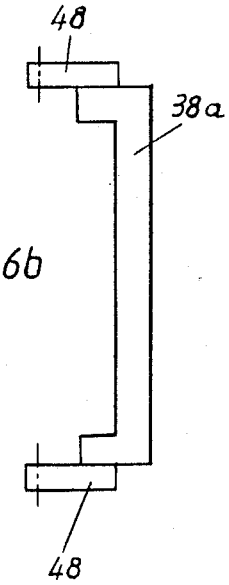
FIG. 6*b* is a plan view of the clamping ledge and its spars in the embodiment of FIG. 6*a;*
Figure 6C:
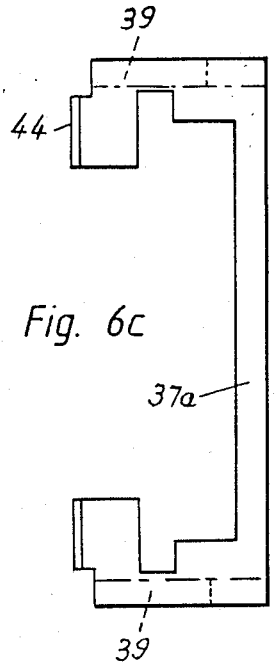
FIG. 6*c* is a plan view of the support angle and its bearing pedestals in the embodiment of FIG. 6*a;*

In FIGS. 3 and 6 the small part 42 is shown clamped between the support angle 37 and clamping ledge 8, with a substantial portion of the part 42 being left unclamped in the region of the U-shaped recess 41. The purpose of this recess, as mentioned above, is to allow the visual pattern to be inspected in the vicinity of the clamping clip 36. On the other hand, in the embodiment of FIGS. 6*a*–6*c*, an extended length of the longitudinal edge of the small part 42 is visible adjacent to the support angle 37*a* and the clamping ledge 38*a*, since the clamping clip does not intercept the small part 42 at its edge, but somewhat further inside the part away from the edge. Therefore, the complete longitudinal edge of the small part 42 can be viewed and matched with the pattern on the main sewing part 43.

Referring now to FIGS. 1–4 and 6 and 6*a*, extending from the support angle 37 there are provided two angularly bent arms 44 to each of which, in accordance with FIG. 3, a further single-acting compressed-air cylinder 46 and a bearing block 47 are fastened by means of to attachment screws 45. To the clamping ledge 38 there are fastened two additional spars 48 each of which can be swung around a pin 49, fastened in the bearing block 47, by an extendable ram 50 of the compressed-air cylinder 46, in any suitable manner, against the action of a spring 51. In this way, the clamping clip 36 is closed and opened as a result of the swinging of the clamping ledge 38.

The clamping clip 36*a* of FIG. 6*a* is shown in more detail in FIGS. 6*b* and 6*c*. FIG. 6*c* is a plan view of the clamping ledge 38*a* and showing the spars 48 on each side thereof. FIG. 6*c* is a plan view of support angle 37*a*, showing the bearing pedestals 39 in phantom on each side thereof. In this embodiment, the support angle 38*a* is made of sheet metal and is bent upward at the portion thereof to the left in FIG. 6*c*, to form the upwardly pointing bent arms 44.

An ordinary commercial first toothed-belt pulley 52 is firmly connected in any suitable manner to the pin 40'. In the upper region of the spar 35 there is fastened, as shown in FIG. 4, a protruding stub shaft 53, which receives a rotatably mounted second toothed-belt pulley 54 which is secured in known manner against unintentional pulling off. Around the toothed belt pulleys 52, 54 there is wrapped a toothed belt 55, thus forming a toothed-belt drive 56.

For this drive, there is provided another double-acting compressed-air cylinder 57, fastened on the frame 32. Its extendable and retractable piston rod 58 is provided on its free end with a threaded extension 59 which is screwed into a threaded hole in a clamping pedestal 60 and is secured against unintentional loosening by means of a locknut 61. Prior to assemble, a spacer sleeve 62 which limits the piston stroke, is pushed over the piston rod 58.

The clamping pedestal 60, the construction of which can be noted from FIG. 4*a*, comprises a block 63 and a pressure part 64 which receive the toothed belt 55 between them. The side of the pressure part 64 facing the belt is also profiled in accordance with the profile of the toothed belt 55, as a result of which a form-locked functional connection of the clamping pedestal 60 to the toothed belt 55 is obtained The block 63 and the pressure part 64 are surrounded by a U-shaped angle 65. In each of its arms there is provided a slot 66 (see FIG. 4) through which the shanks of respective screws 67 extend. By the latter, and the angle 65, the clamping pedestal 60 is reliably held together. By means of a screw 64', the pressure part 64 is furthermore firmly connected to the angle 65.

Referring again to FIGS. 1–3, on the arm 10 of he sewing machine 3, directly in front of a sewing station 68, there is provided a holding-down device 69 for pressing down the unclamped portion of the small sewing part 42. With the lowering of the sewing-material clamp 8, the holding down device 69 is also lowered in such a manner that by its own weight it presses on the main part 43 and possibly also on the small part 42. With the lifting of the sewing-material clamp 8, the holding-down device 69 is also lifted. The manner of operation and construction of the holding-down device 69 are already known from Federal Republic of Germany OS No. 21 23 160, in which it is referred to as a fold-rail piece, so that further description can be dispensed with here.

Above the worktable 2 in the region of the feed station 7, as shown in FIG. 5, there is provided a feed table 70 which is mounted on a spar 17*a*. The top of the feed table 70 can be so inclined around a pivot axis 71 extending parallel to the direction of sewing N that said top side of the feed table 70 can be adjusted to the worktable 2. On the top side of the feed table 70, there ar provided, in known manner, two adjustable stops 73 and 74 which, on the one hand, can be adapted to the shape of the specific small part 42 and, on the other hand, are adjustable corresponding to the initially aligned position of the main part 43 spread out on the worktable 2. Thus the carefully adjusted stops 73, 74 permit the correct depositing of the small part 42 in predetermined position on the feed table 70.

The manner of operation of the device of the invention for the pattern-matched sewing of a small part 42 on a main part 43 will now be described.

The main part 43 is first spread out on the worktable 2 with its front side facing upward and is pushed into an initially aligned position which is indicated by light markings projected by the marking lights 19, or by other markings arranged on the worktable 2.

Referring now to FIG. 5, the small part 42 is placed, with its front side 76 facing upward, against the suitably aligned stops 73, 74 on the feed table 70, so that the open long side of the small part 42 protrudes beyond the feed table 70 as shown in FIG. 5. During the prior sewing process, the sewing-material clamp 8 is located either in the region of the sewing point 68 or in the region of the cutting station 6. By actuation of the two compressed-air cylinders 46, the clamping clip 36 is closed, as a result of which the protruding edge region of the small part 42 is now located within the clamping clip 36. By the actuation of the compressed-air cylinder 14, the carrier 13 is swung so far in clockwise direction around the journal pin 12, that the carrier 13 strikes against the extended ram 1 of the compressed-air cylinder 16. The transfer unit 31 is now in its upper position, shown in FIG. 6.

The compressed-air cylinder 28 is then actuated, as a result of which the transfer unit 31 is brought linearly into its lowered position, visible in FIG. 7, in which the small part 42, which is held clamped, is located directly above the initially aligned main part 43. The operator now checks the direction of the pattern of the small part 42 on all four of its sides against the direction of the pattern of the main part 43. If he or she notes a mismatch in the pattern, the operator moves the main part 43 slightly until there is agreement between the patterns of the two parts. On the other hand, if the operator notes different spacings in the respective repeats of the small part 42 and the main part 43, these differences are eliminated in the region of the pocket insert to be produced on the main part 43 by slightly pulling the material apart or pushing it together. The operator then actuates a knee switch or foot switch (not shown), whereupon, in a manner which is known, the main part 43 is fixed in position, by production of a vacuum, on the resting surface 72 of the worktable 2.

Figure 8:
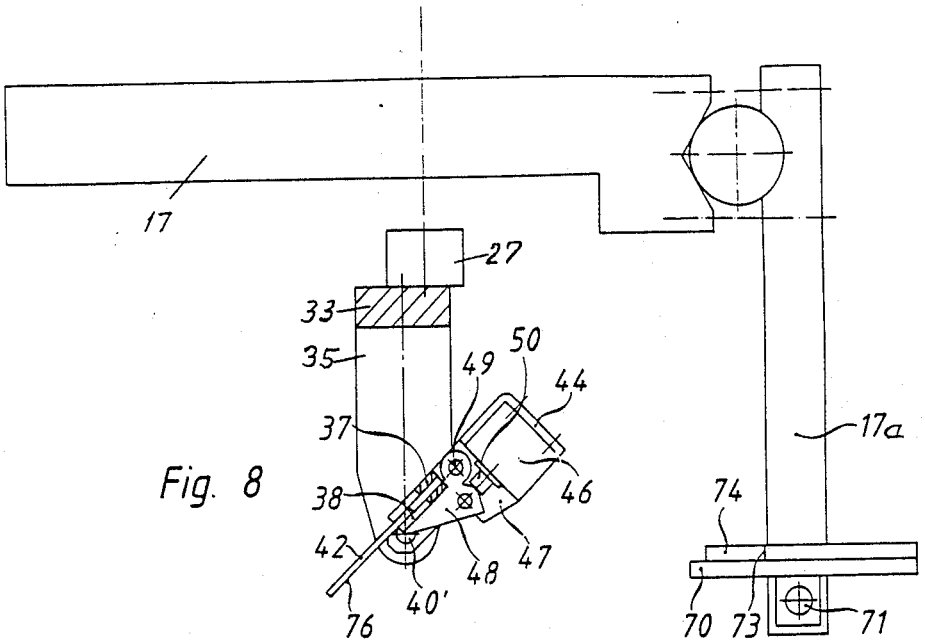
FIG. 8 is a view similar to FIG. 5, of the transfer unit in its raised position, the front side of the clamped small part now facing downward after the rotation of the clamping clip.

The transfer unit 31 is then brought by corresponding actuation of the compressed-air cylinder 28 into its raised position, the clamping clip 36 being rotated at the same time by about 150° in clockwise direction, as shown in FIG. 8. By this rotation, the front side 76 of the small part 42 is now facing downward. If the prior sewing and cutting process has been completed, the sewing-material clamp 8, which has been lifted in the meantime, can move back into the feed station 7. Upon its arrival, the sewing-material clamp descends, as does the holding down device 69, onto the main part 43.

Since the clamping clip 36 has been rotated—as previously described—through an angle of less than 180°, the small edges of the small part 42 have been shifted transversely; in this case, toward the left as seen in FIG. 8. This shift would be equal to zero if the clamping clip 36 were rotated by 180°. The smaller the angle of swing—about 150° in the embodiment shown—the greater the shift will be. The result is that the pattern over the transverse sides of the small part 42 now no longer agrees with the pattern of the main part 43, despite the previous precisely effected alignment. In order to compensate for this displacement of the pattern, the carrier 13 and thus the transfer unit 31 must be rotated, in addition, through an additional empirically determined angle in clockwise direction. For this purpose, simultaneously with the above-described rotation of the clamping clip 36 by about 150°, the compressed-air cylinder 16 is vented, as a result of which its ram 15 moves inward slightly. The compressed-air cylinder 14, which is still actuated, now swings the carrier 13, and thus the transfer unit 31, through a defined angle in clockwise direction until the carrier 13 strikes against the ram 15, which has now been somewhat retracted. With the above-described rotation of the transfer unit 31, an equalization of the various angular displacements is effected. This has the result that upon rotation of the clamping clip 36 through an angle of less than 180°, a dependable pattern-matching sewing of the small part 42 onto the main part 43 is nevertheless assured In this connection, it will be seen that such an equalization need not be effected if the clamping clip 36 is swung through an angle of precisely 180°. In this case, what takes place is a mirror-image rotation of the small part 42 around the subsequent sewing seam for the attachment of the small part 42 to the main part 43.

Figure 9:
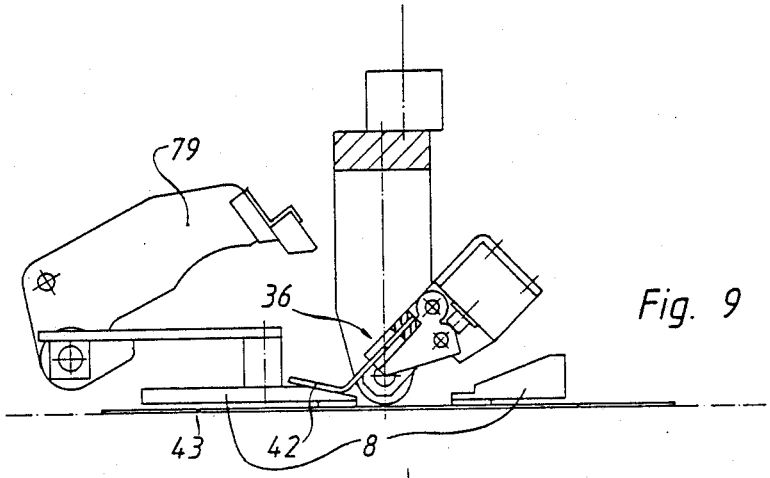
FIG. 9 is a view similar to FIG. 5, of the transfer unit, which is in the process of placing the small part on the sewing material clam,, while in its lowered position.
Figure 10:
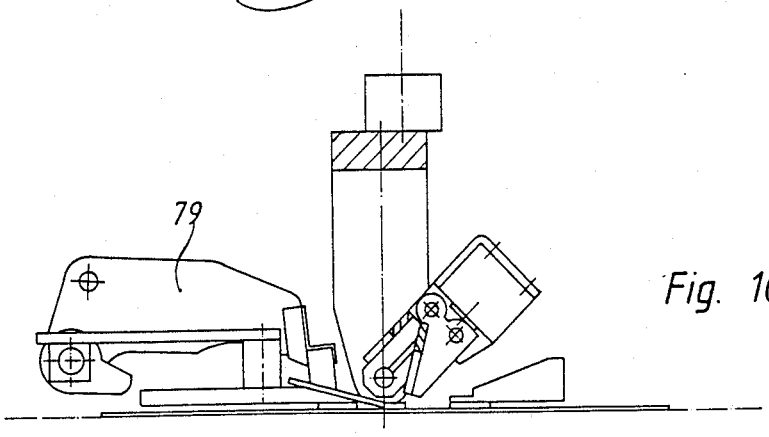
FIG. 10 is a view similar to FIG. 5, of the transfer unit in its lowered position with the clamping clip having opened and released the small part, the small part now having been clamped firmly to the sewing material clamp 8 by a clamping lever 79.

The compressed air cylinder 28 is then again actuated in such a manner that the transfer unit 31 is brought into the lowered position shown in FIG. 9. The clamping lever 79, which is swingably mounted in a known manner on the sewing material clamp 8, is then swung in clockwise direction, as a result of which the small part 42 placed on the sewing-material clamp 8 is clamped fast, as shown in FIG. 10. After the fastening thereof by the clamping lever 79, the compressed-air cylinders 46 are vented, as a result of which the clamping clip 36 is opened, also as seen in FIG. 10. The transfer unit 31 then moves back on a straight path into its raised position, at the same time being swung by the aforementioned compensation angle in clockwise direction and the clamping clip 36 also being swung in counterclockwise direction through an angle of 150°. When the upward moving transfer unit 31 is outside the range of movement of the sewing-material clamp 8, the latter travels, together with the main part 43 and the small part 42, as well as a pocket bag which has been inserted previously in known manner between the main part 43 and the sewing-material clamp 8, first of all to the sewing point 68 and then into the cutting station 6. Since the pocket bag, which is to be sewed by the sewing needle 78 to the main part 43, is not essential for the invention, it is not further described or shown here Simultaneous with the above-described travel of the sewing-material clamp 8 to the sewing point 68, the carrier 13, and with it also the transfer unit 3 are swung, by corresponding actuation of the compressed-air cylinder 14, starting from the raised position into the transfer position shown in FIG. 5. Since the open clamping clip 36 is now opposite the feed table 70, the next-following small part 42 can now be placed on the feed table 70. The cycle of operation described above then takes place again.

The actuation of the aforementioned compressed-air cylinders is controlled, in known manner, by an electro-pneumatic control 80, which is not further described here.

Although illustrative embodiments of the invention have been described herein, the appended claims are not to be limited to such embodiments, but rather are to be interpreted as including any modifications and variations which may occur to an ordinary skilled person within the spirit and scope of the invention.

What is claimed is:

1. A method of attaching a pocket insert, comprising the steps of:

spreading out a main sewing-material part with an upward-facing front side and aligned at a predetermined position on a worktable of an automatic pocket-insert sewing machine;

lowering a sewing-material clamp onto the main part;

placing a small sewing part with a downward-facing front side at a predetermined position on the sewing-material clamp; and swinging a clamp lever on the sewing-material clamp to fix the position of the small part relative to the main part; wherein the following steps are carried out at a feed station for placing the small part on the sewing-material clamp and sewing the small part on the main part in accordance with a visual pattern of the main part:

clamping the small part in a transfer unit and moving the transfer unit to a low position in which the upward-facing front side of the small part is directly above the spread-out main part;

aligning the main part in accordance with the direction of the pattern of the small part, and then holding the main part fast in fixed position on the worktable;

moving the transfer unit to a raised position, which removes it from the path of the sewing-material clamp into the feed station, and turning the small part in the transfer unit so that its front side now faces downward; and placing the small part on the sewing material clamp, clamping the small part fast thereon, and then loosening its clamping in the transfer unit and releasing it from the transfer unit.

2. A method as in claim 1, further comprising the steps of:

transporting the main part and the small part by the sewing-material clamp to a sewing station and then to a cutting station of the automatic pocket-insert sewing machine

3. A method as in claim 1, further comprising the step of:

aligning the main part on the worktable in accordance with light marks on the worktable.

4. A method as in claim 1, further comprising the following steps:

placing the small part with its front side facing upward on a feed table it the feed station at a position determined by stops;

gripping the small part by a clamping clip in the transfer unit, the transfer unit being swingable about an axis with respect to a frame of the sewing machine as well as lowerable and raisable;

by swinging the transfer unit through a swing angle, removing the small part from the feed table, and then bringing the transfer unit into the lowered position for aligning the patterns of the small and main parts;

then bringing the transfer unit to a raised position and turning the clamping clip by a predetermined turning angle; and, at the same time, swinging the transfer unit through an additional angle to compensate for said turning of the small part through said turning angle; then bringing the transfer unit into its lowered position for transferring the small part to the sewing-material clamp;

after transferring and clamping the small part to the sewing-material clamp, and after opening the clamping clip, bringing the transfer unit again to its raised position, the transfer unit being swung through an angle opposite o said swing angle and said additional angle, and the clamping clip, upon the reaching of the raised position, being turned through an angle opposite to said turning angle; and then moving the transfer unit, which is in its raised position, to adjacent the feed table to prepare the transfer unit for gripping the next small part to be attached to a respective main part.

5. A method as in claim 4, wherein said turning angle is substantially 150°.

6. An automatic pocket-insert sewing machine comprising:

a frame; a feed station, sewing station and cutting station defined with respect to the frame; and a worktable supported on the frame;

a two-needle sewing machine on the frame;

cutting means disposed for cutting workpieces at a portion thereof between the respective sewing paths of the two sewing needles;

a carrier swingably supported with respect to the sewing machine and having supporting beam means mounted for linear displacement therein;

a sewing-material clamp for the transport of a main sewing part and a small sewing part which is movable between the feed station and the cutting station; holding-down means provided in the vicinity of the sewing station for holding down workpieces; and cutting means at the cutting station for producing gusset cuts at the ends of the small sewing part;

feed table means which is arranged for receiving said small part with a predetermined orientation with respect to the frame and the sewing machine; and transfer means supported on said support beam means for transferring said small part from said feed table to said sewing-material clamp.

7. A machine as in claim 6, wherein said holding-down means holds down a portion of said small sewing part, which portion is not clamped in said sewing-material clamp.

8. A machine as in claim 6, wherein said carrier is swingable for moving said transfer means through a swing angle from said feed table means to said sewing-material clamp, and further comprising means for controlling the swing angle of said carrier

9. A machine as in claim 8, wherein said means for controlling the swing angle of said carrier comprises a pressure cylinder fixed with respect to the frame and having a piston which is settable for stopping said carrier when it has swung through a given swing angle.

10. A machine as in claim 9, wherein said pressure cylinder is a pneumatic cylinder.

11. A machine as in claim 8, wherein said transfer means comprises:

a transfer unit, said transfer unit including a clamping clip which is mounted thereon and rotatable about an axis substantially parallel to the direction of sewing; and means for rotating said clamping clip through a turning angle from a pattern-matching position in which said small part is oriented generally face-up for matching its pattern to the pattern of the main sewing part, to a clamping position in which said small part is oriented generally face-dow for being clamped in said sewing-material clamp in position for being sewn onto said main part for forming a pocket insert.

12. A machine as in claim 11, wherein said turning angle is substantially 150°.

13. A machine as in claim 11, wherein said swing angle of said carrier includes an additional angle which compensates for said rotation of said small part through said turning angle to maintain said matching of said patterns.

14. A machine as in claim 13, including means for controlling the swing angle of said carrier to swing said carrier through said additional angle when said transfer unit rotates said small part

15. A machine as in claim 11, wherein said means for rotating said clamping clip comprises pulley means connected to said clamping clip for rotating the same; belt means for turning said pulley means; and pressure cylinder means providing a linear motion and including piston means linked to said belt means for transferring said linear motion to said belt means.

16. A machine as in claim 15, wherein said pressure cylinder means includes a pneumatic cylinder.

17. A machine as in claim 16, wherein the clamping clip includes a support angle and a clamping ledge which is pivotable relative to it; said support angle being rotatable relative to said carrier; and further comprising a pair of compressed-air cylinders on the support angle; means actuated by said cylinders for closing said clamping ledge with respect to said support angle; and a spring resisting said closing, for unclosing said clamping ledge when said cylinders are not actuated.

18. A machine as in claim 6, wherein the top of the feed table is tiltable about a swivel shaft which is aligned substantially parallel to said worktable and parallel to said direction of sewing, and two adjustable stops are provided on the feed table.

* * * * *